US008339271B2

(12) United States Patent
Tabib

(10) Patent No.: US 8,339,271 B2
(45) Date of Patent: Dec. 25, 2012

(54) INTELLIGENT SECURITY CONTROLLER

(76) Inventor: Isac Tabib, White Plains, NY (US)

( * ) Notice: Subject to any disclaimer, the term of this patent is extended or adjusted under 35 U.S.C. 154(b) by 771 days.

(21) Appl. No.: 12/553,657

(22) Filed: Sep. 3, 2009

(65) Prior Publication Data

US 2010/0052928 A1 Mar. 4, 2010

Related U.S. Application Data

(60) Provisional application No. 61/094,220, filed on Sep. 4, 2008.

(51) Int. Cl.
*G08B 21/00* (2006.01)

(52) U.S. Cl. ..... 340/653

(58) Field of Classification Search ..... 340/653, 340/541, 286.02
See application file for complete search history.

(56) References Cited

U.S. PATENT DOCUMENTS 7,256,683 B2 8/2007 Bullmore
7,467,400 B1 12/2008 Moss et al.
8,099,054 B2 * 1/2012 Tabe ..... 455/63.1
2008/0007415 A1 1/2008 Bullmore
2008/0068161 A1 3/2008 Burwell et al.
2008/0068783 A1 3/2008 Burwell et al.
2008/0284614 A1 11/2008 Perez et al.
2008/0291643 A1 11/2008 Farago et al.

OTHER PUBLICATIONS

ATMEL Corporation; Atmel AT91SAM9G20 Summary; 6384BS-ATATM; Dec. 15, 2008; 39 pages.
Octal Channel High Side Driver; VN808-E; STMicroelectronics; www.st.com; Aug. 2008; 18 pages.
Software House Data Sheet; Input/output Modules; TYCO International Ltd.; www.swhouse.com; 2008; 2 pages.

* cited by examiner

*Primary Examiner* — Shirley Lu
(74) *Attorney, Agent, or Firm* — St. Onge Steward Johnston & Reens LLC

(57) ABSTRACT

An intelligent security system that can be retrofit with existing equipment in the field, where the system, upon connection to existing End-Of-Line resistors automatically reads and calibrates itself to function with the various resistors already installed. The system provides for interrogation of non-supervised devices and may be remotely managed via a network connection. The system is designed as a fully integrated and easy to install security system that minimizes installation time and costs and provides for a compact and neat controller.

8 Claims, 5 Drawing Sheets

INTELLIGENT SECURITY CONTROLLER

CROSS-REFERENCE TO RELATED APPLICATIONS

This patent application claims the benefit, under 35 U.S.C. §119(e), of U.S. Provisional Patent Application Ser. No. 61/094,220, filed on Sep. 4, 2008, which is hereby incorporated by reference herein.

FIELD OF THE INVENTION

The invention relates to an integrated security system and more particularly, to a fully integrated and intelligent security controller that is able to automatically detect, configure, process and report information.

BACKGROUND OF THE INVENTION

Building security systems have been in use for many years. Some of these systems allow for remote monitoring of, and provide for access control to, restricted areas. Access control is the ability to permit or deny the use of a particular credential by a particular entity. A security access control system determines who, where and when one is allowed to enter or exit an area. Electronic access control uses computers to solve the limitations of mechanical locks and keys. The electronic access control system grants access based on the credential presented. When access is granted, a door, for example, is unlocked for a predetermined time and the transaction is recorded in a database. When access is refused, the door remains locked and the attempted access is recorded. The system also monitors the door and alarms if the door is forced open or held open too long after being unlocked. A user can access a door with the use of a swipe/proximity access card, key fob, or the use of a biometric reader. There are many card technologies including magnetic stripe, bar code, proximity, Wiegand, RS-232, RS-485, contact smart cards, and contactless smart cards. Typical biometric technologies include fingerprint, facial recognition, iris recognition, retinal scan, voice, and hand geometry.

When a credential is presented to a reader, the reader sends the credential's information, typically an identifying numbered sequence, to a control panel which is a highly reliable processor. The control panel compares the credential's number to an access control list and other conditions, and either grants or denies the presented request, and sends a transaction log to the host computer database. When access is denied based on the access control list the door remains locked. If there is a match between the credential and the access control list, the control panel operates a relay that, in turn, unlocks the door. The control panel also ignores the subsequent door open signal to prevent an alarm. Often the reader provides feedback, such as a flashing red LED for an access denied and a flashing green LED for an access granted.

An access control point can be a door, turnstile, parking gate, elevator, or other physical barrier where granting access can be electrically or electro-mechanically controlled. Typically, the access point is a door. A typical electronically secured access control door deploys, at a minimum: 1) an electrified lock; 2) an access card reader; 3) a door status monitor; and 4) a request to exit device.

To maintain a building's security and to prevent tampering, all access control controllers (processors) must be installed within a secured space. Additionally, a typical security system will monitor the integrity of wiring between the alarm controller and the associated Remote Monitored Device (RMD). RMDs can be items such as, but not limited to, panic buttons, door status monitors, temperature monitors, alarm points and other low voltage inputs.

In order to prevent individuals from defeating various security measures, such as a door open alarm caused by an unauthorized door entry, various measures have been put into place to prevent defeating of the RMD. For cable fault and device status, a resistor is placed at the "end of line" (EOL), which is as close to the remote sensor/device as possible. The controller then transmits a low current through each resistor (s) configuration and depending on the amount of voltage read across the resistor(s) configuration, the controller then senses 1) the presence of the EOL resistor(s) and 2) the voltage value, which is dependent on the EOL value. By using this technique, with the use of, for example, two EOL resistors in a series/parallel arrangement, five separate conditions can be achieved: 1) Normal (secure); 2) Alarm; 3) Open; 4) Short; and 5) Trouble (measured voltage is out of expected range).

These EOL resistors are typically installed by hand as close to the device in the field as feasible and coupled to the controller. A problem past systems faced is that, when retrofitting a new security system, the new system could only be used with specific resistance values. This meant that the value of the EOL resistor(s) had to be known in advance and had to match the controller's designed and expected resistance values. For example, if the controller expects to sense a 1,000 ohm resistor, then the installer must install a resistor(s) of such value adjacent to the monitored device. If the installed resistor is for example 2,000 ohms, which would be out of the expected range of the controller, then the controller would issue a "trouble" notice. In order to return to normal, the installer then had to physically go to the EOL 2,000 ohm resistor(s), including first finding it and then replacing it with the correct value the controller was expecting.

Various systems have been proposed to help deal with this problem with varying degrees of success. For example, U.S. Pat. No. 7,256,683 (the '683 patent) and U.S. Patent Application Publication No. 2008/0007415 (the '415 appln.) both disclose a PLC controller for a security system that may be manually programmed to operate with various EOL resistors. For example, the '683 patent states that if the "system being replaced uses field resistors having a different value, then the EOL modules can be reprogrammed for that value." (Col. 8, Ins. 1-3; see also, the '415 appln. p. 2, ¶12). However, a problem with the systems taught in these references is that when the new security system is installed, a technician is required to measure the resistance of each and every EOL resistance value in the various states of operation (e.g. resistance measurement for door open/closed, etc.) and then manually input this information into the system. While this is better than having to replace all the EOL resistors, this is still a very time-consuming and expensive process. Additionally, this process is inherently subject to human error in the measurement and inputting process.

Another problem with current security systems is that when a device goes into alarm, for example a card reader may be in alarm, there is no means of remotely determining the origin of the problem for trouble-shooting purposes. For example, a card reader may go into alarm for various reasons. Typically, a technician would be dispatched to the building, would access the security panel, and would then begin looking through the various devices to determine the origin of the alarm. Once located, the technician would then proceed to the location of the device and attempt to clear and/or fix the cause of the alarm. Often, the alarm can be cleared simply by resetting the device (e.g., disconnecting and reconnecting to power). Even though it was a relatively simple matter to clear the alarm, the technician had to spend significant time to travel to the building location, locate and identify the source of the alarm and then reset the device. This results in significant costs to the building owner.

Still another problem with current security systems is the size of the systems. For example, it is not uncommon for a security system that monitors and actuates thirty two doors to essentially cover an eight foot tall by eight foot wide space of a wall in an equipment room. Currently, systems are not only very large, but are also unsightly and are labor intensive to install.

SUMMARY OF THE INVENTION

Accordingly, what is desired then is a security system that can be retrofit with existing equipment in the field, where the system, upon connection to existing EOL resistors, automatically reads and calibrates itself to function with the various resistors already installed.

It is also desired to provide a system and method wherein an alarm sent to the security system may be remotely managed.

It is further desired to provide fully integrated and easy to install security system that minimizes installation time and costs and provides for a compact and neat controller.

These and other objectives are achieved in one advantageous embodiment by the provision of a snap in method of installing access control panels, which reduces the amount of labor and installation that is required to be performed by the installers. The intelligent security system is a data center compliant control appliance that interfaces with other existing manufactured access control systems and software. When integrating the intelligent security system with an existing system in place, there is no modification of a manufacturer's software required. The user friendly configuration permits the end user to easily interface the intelligent security system with existing software, utilizing the manufacturer's specific protocols.

The intelligent security system in various embodiments provides a number of significant features including:

1. The mounting methodology of a small, low power rack mountable controller that fits within standard 19" data style racks vs. utilizing wall space, thus making security become "Data Center Compliant."

2. Security controllers that are user friendly and easy to install, terminate, program and maintain, thus reducing cumbersome and expensive labor and installation, largely attributeable to the need to no longer use screws, conduits, fittings and high power (110VAC) distribution.

3. The intelligent security system is an all-in-one solution that includes onboard diagnostics, testing and support, as well as provides simple and quick modular connections of network and other communication needs, thus reducing wiring requirements.

4. Is equipped with diagnostic LEDs and a tricolored status LCD display making commissioning and ongoing maintenance easier and more efficient, as well as diagnostic and trouble-shooting service issues easier to correct.

5. Has a built-in mechanism for connection to life safety and various locking systems, meeting "in-the-field" and industry life safety requirements, as well as provides for "Clean" wire management and cable termination, resulting in simplified installation, commissioning and ongoing maintenance for high density configuration.

In one advantageous embodiment, the intelligent security system provides for automatic detection of existing EOL resistors. For example, in retrofitting the intelligent security system with existing RMDs, the installer does not need to manually measure the resistance of the EOL resistor(s) and manually program this information into the controller. Rather, the installer need only connect the existing wires to the new controller, which will read the resistance and calibrate itself to function with the measured values.

In another advantageous embodiment, the intelligent security system is provided with a microprocessor (in a controller) that controls and monitors multiple RMDs. Typically, these microprocessors are provided with only one "alarm" output even though they control/monitor multiple RMDs. The controllers in turn are coupled to a network connection (such as the Internet) and may be monitored from a remote location. The microprocessors utilized are capable of switching individual inputs and outputs on and off. Accordingly, when an alarm is received from one of the microprocessors, the inputs/outputs of that particular microprocessor can be cycled on/off to see which device is in alarm (e.g. the alarm will go off with the particular device output is turned off) thereby indicating which RMD is in alarm. Often times, simply cycling the RMD on/off can clear the alarm. If not, the technician is provided with information relating to the specific device/location of the alarm prior to looking at the system.

For this application the following terms and definitions shall apply:

The term "data" as used herein means any indicia, signals, marks, symbols, domains, symbol sets, representations, and any other physical form or forms representing information, whether permanent or temporary, whether visible, audible, acoustic, electric, magnetic, electromagnetic or otherwise manifested. The term "data" as used to represent predetermined information in one physical form shall be deemed to encompass any and all representations of the same predetermined information in a different physical form or forms.

The term "network" as used herein includes both networks and inter-networks of all kinds, including the Internet, and is not limited to any particular network or inter-network.

The terms "first" and "second" are used to distinguish one element, set, data, object or thing from another, and are not used to designate relative position or arrangement in time.

The terms "coupled", "coupled to", and "coupled with" as used herein each mean a relationship between or among two or more devices, apparatus, files, programs, media, components, networks, systems, subsystems, and/or means, constituting any one or more of (a) a connection, whether direct or through one or more other devices, apparatus, files, programs, media, components, networks, systems, subsystems, or means, (b) a communications relationship, whether direct or through one or more other devices, apparatus, files, programs, media, components, networks, systems, subsystems, or means, and/or (c) a functional relationship in which the operation of any one or more devices, apparatus, files, programs, media, components, networks, systems, subsystems, or means depends, in whole or in part, on the operation of any one or more others thereof.

The terms "process" and "processing" as used herein each mean an action or a series of actions including, for example, but not limited to the continuous or non-continuous, synchronous or asynchronous, direction of data, modification, formatting and/or conversion of data, tagging or annotation of data, measurement, comparison and/or review of data, and may or may not comprise a program.

In one advantageous embodiment an intelligent security system is provided comprising a processor, a storage accessible by the processor and at least one remotely monitored device coupled to the processor. The system further comprises at least one end-of-line resistor located in the vicinity of the at least one remotely monitored device, the at least one end-of-line resistor comprising a circuit where the circuit is coupled to the processor. The system is provided such that the processor applies a current across the circuit and the processor measures a voltage that develops across the circuit and determines a resistance thereof. The system is further provided such that the processor stores the circuit resistance in the storage and the processor automatically sets its operational settings in accordance with the circuit resistance such that when the processor reads the circuit resistance the system registers normal operation. Finally when the processor reads a resistance that exceeds a threshold deviation from the circuit resistance, the system registers an alarm.

In another advantageous embodiment an intelligent security system is provided comprising an integrated circuit having a first and a second input and a first and a second output corresponding to the first and second inputs, the integrated circuit also having an alarm output. The system further comprises a processor coupled to the at least two inputs and to the alarm output and coupled to a storage, and a computer coupled to the processor via a network connection. The system is provided such that the first output is coupled to a first remotely monitored device and the second output is coupled to a second remotely monitored device. The system further comprises a threshold value stored in the storage and a first measured value for the first remotely monitored device and a second measured value for the second remotely monitored device, wherein if either the first or second measured values exceed the threshold value, an alarm signal is sent via the alarm output. The system is provided such that the computer transmits a command signal to the processor to turn one of the first or second inputs off and where the remotely monitored device that is in causing the alarm is identified by the cycling on and off of the first and second inputs. The system still further comprises at least one end-of-line resistor located in the vicinity of the first remotely monitored device, the at least one end-of-line resistor comprising a circuit coupled to the integrated circuit. The system is still further provided such that the processor applies a current across the circuit, the processor measures a voltage that develops across the circuit and determines a resistance thereof, and the processor stores the circuit resistance in the storage. Finally, the system is provided such that the processor automatically sets its operational settings in accordance with the circuit resistance such that when the processor reads the circuit resistance the system registers normal operation and when the processor reads a resistance that exceeds a threshold deviation from the circuit resistance, the system registers an alarm.

In still another advantageous embodiment an intelligent security system is provided comprising an integrated circuit having a first and a second input and a first and a second output corresponding to the first and second inputs, the integrated circuit also having an alarm output. The system further comprises a processor coupled to the first and second inputs and to the alarm output and coupled to a storage, and a computer coupled to the processor via a network connection. The system is provided such that the first and second outputs are coupled to first and second remotely monitored devices, respectively. The system still further comprises a threshold value stored in the storage and a first and a second measured value for the first and second remotely monitored devices, respectively, wherein if either the first or second measured values exceed the threshold value, an alarm signal is sent via the alarm output. The system is still further provided such that the computer transmits a command signal to the processor to turn one of the first or second inputs off and the remotely monitored device that is in causing the alarm is identified by the cycling on and off of the first and second inputs.

Other objects of the invention and its particular features and advantages will become more apparent from consideration of the following drawings and accompanying detailed description.

DETAILED DESCRIPTION OF THE INVENTION

Figure 1:
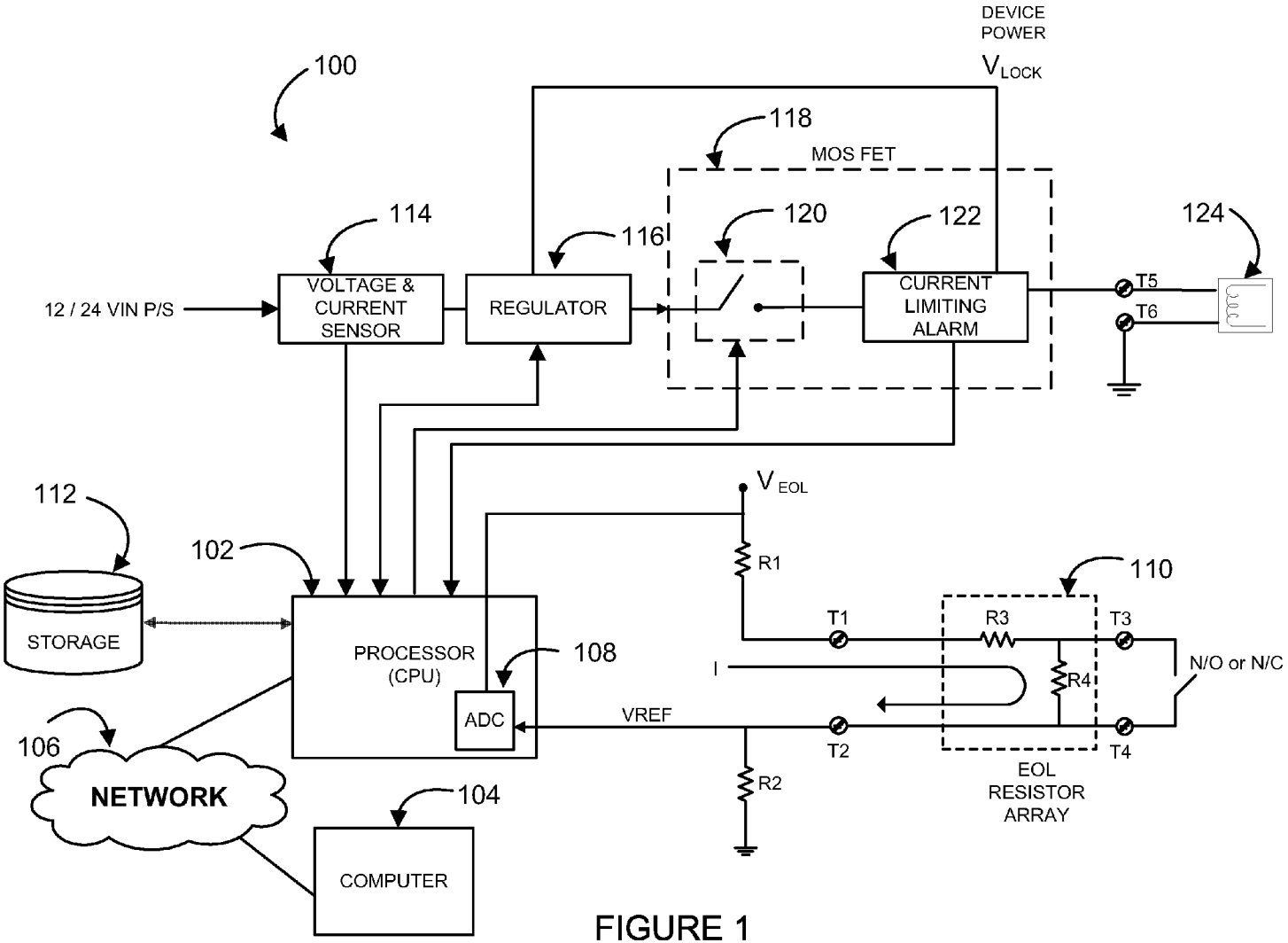
FIG. 1 is a block diagram of one advantageous embodiment of the present invention.

Referring now to the drawings, wherein like reference numerals designate corresponding structure throughout the views.

FIG. 1 illustrates an advantageous embodiment of Security System 100. Security System 100 as shown in FIG. 1 includes a processor (CPU) 102 coupled to a computer 104 via a network connection 106. In one advantageous embodiment, the processor 102 may comprise, for example, the AT91SAM9G20 manufactured by Atmel® Corporation. It is further contemplated that computer 104 may comprise virtually any type of personal computer(s) and/or sever configuration that is capable of communication via a network connection and may comprise one or more computers or devices facilitating communication between computer 104 and processor 102.

Processor 102 is shown having an analog-to-digital converter 108 located therein that is coupled to an End-Of-Line (EOL) resistor array 110 via connections $T_1$ and $T_2$. The functional operation of resistors $R_1$, $R_2$ as well as $R_3$ and $R_4$ ($R_T$) will be described in connection with FIGS. 2-4 under heading End Of Line Resistor(s). EOL resistor array 110 is further illustrated coupled to a Normally Open (NO) or Normally Closed (NC) switch or device via connections $T_3$ and $T_4$.

A storage 112 is accessible by processor 102. Storage 112 may comprise virtually any type of data storage including, for example, but is not limited to RAM, ROM, EPROM, EEPROM, a hard drive, a removable medium such as a magnetic or optical disk, a jump/thumb drive or the like and may or may not be remotely located in the vicinity of processor 102. For example, while storage 112 is shown adjacent to processor 102, it is contemplated that storage 112 may be remotely coupled to processor 102 via a network connection 106.

Also shown in FIG. 1 is voltage and current sensor 114, which is coupled to processor 102 and regulator 116, which is also coupled to processor 102. Voltage and current sensor 114 is provided with 12/24V power. MOS FET 118 is further illustrated in FIG. 1 including switch 120 and current limiting alarm 122, which are each coupled to processor 102. In one advantageous embodiment, the MOS FET 118 may comprise, for example, the VN808-E manufactured by STMicroelectronics. MOS FET 118 is further shown coupled between regulator 116 and a device 124 via connections $T_5$ and $T_6$. It is contemplated that device 124 may comprise, but is not limited to, in one advantageous embodiment, an electrified lock, an access card reader, a door status monitor and/or a request to exit device. The function and operation of voltage and current sensor 114, regulator 116 and MOS FET 118 is described in connection with FIG. 5 under heading Output Supervision.

Referring back now to voltage and current sensor 114, the intelligent security system 100 may be provided with several current and voltage sensors. By the use of software, the system 100 is able to determine the current draw along several different branches (busses). As an example, by turning off switch 120 power is cut off from device 124 (e.g. electronic lock). By measuring overall current while switch 120 is on (i.e. lock active) versus the overall current that is detected by voltage and current sensor 114. When switch 120 is open (i.e. lock not active) then the system is able to determine the current drawn by device 124 as controlled by the processer 102 connection (shown as arrow from processor 102 toward switch 120) to switch 120. Current sensing measurements may also be fed to processor 102 by voltage and current sensor 114 (shown as arrow from voltage and current sensor 114 toward processor 102).

The regulator 116 accepts the 12/24 VIN and produces the several regulated derivatives, for example $V_{LOCK}$ to power the locks (devices) and $V_{EOL}$. The regulator 116 is controlled and its output measured and analyzed by the processer 102 (shown as bidirectional arrow between regulator 116 and processor 102). A highly regulated and stabilized derivative of the regulator 116 is used to drive the voltage divider ($R_1$, $R_2$ and End-Of-Line (EOL) resistor array 110) and simultaneously is fed to the ADC 108 to achieve a highly accurate 10-bit resolution detection of variations in the value of End-Of-Line (EOL) resistor array 110.

The Voltage Divider circuit is fed by $V_{EOL}$. By changing the resistor values and configuration in End-Of-Line (EOL) resistor array 110, current (i) will vary accordingly and voltage drop $V_{REF}$ over $R_2$ is then fed to the ADC 108 for a 10-bit resolution depiction of the changes in the value of End-Of-Line (EOL) resistor array 110.

Current limiting is an integral part of the MOS FET 118. This portion of the circuitry analyzes and limits the current that can be drawn by the load (e.g. device 124). In the event the current draw exceeds a specified amount then current limiting alarm 122 removes $V_{LOCK}$ from the load (e.g. device 124) and a signal is sent notifying processor 102 of the alarm condition (shown as arrow from current limiting alarm 122 toward processor 102).

Various embodiments of the invention will now be discussed in greater detail with relation to the automatic identification of End Of Line Resistor(s) and Output Supervision.

End Of Line Resistor(s). The typical security system needs to monitor the integrity of wiring between the alarm controller and the associated Remote Monitored Device (RMD). For cable fault, and device status, a resistor(s) is placed at the 'end of the line' (EOL), i.e., as close to the sensor as possible, and may comprise a single, or multiple resistors. With a use of two EOL resistors in a series/parallel arrangement, for example, five separate conditions can be achieved: Normal (secure), Alarm, Open, Short and Trouble (Returned voltage is out of the expected window).

Figure 2:
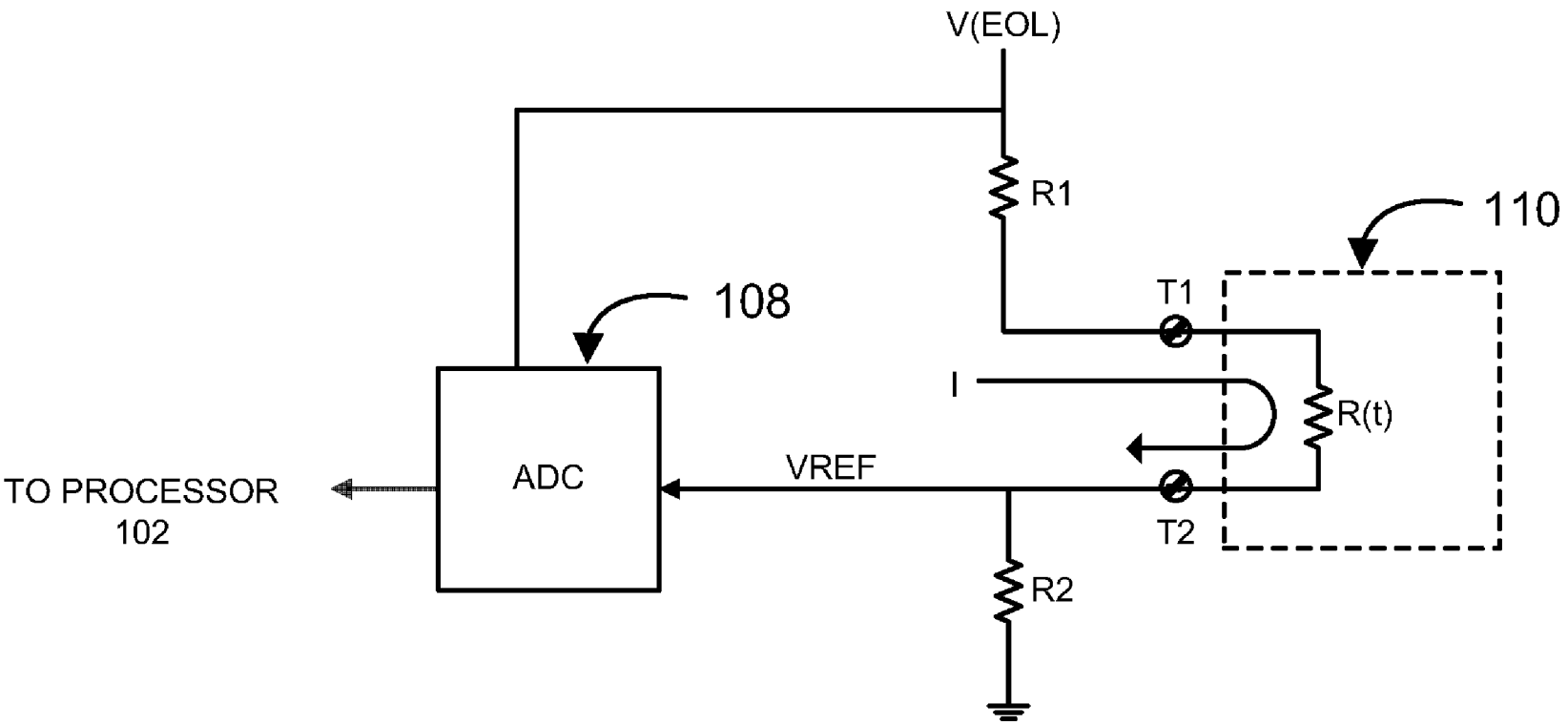
FIG. 2 is a block diagram of the advantageous embodiment according to FIG. 1.

Referring now to FIG. 2, the intelligent security systems allows for the controller to accept or "learn" the value of any installed EOL resistor(s) 110 negating the need to make a visit to the site and replace the resistor pack.

A stable DC power supply, $V_{EOL}$ feeds an array of voltage divider resistor pack ($R_1$ & $R_2$). As a result, a certain voltage is exposed on an input to the analog-to-digital converter (controller) 108 (here shown separate from processor 102). Based on the value of the EOL resistor R(t), a voltage divider is created between $R_1$, R(t), and $R_2$, producing a Reference Voltage $V_r$. $V_r$ is a direct derivative, and is in direct relationship to the value of R(t).

Figure 3:
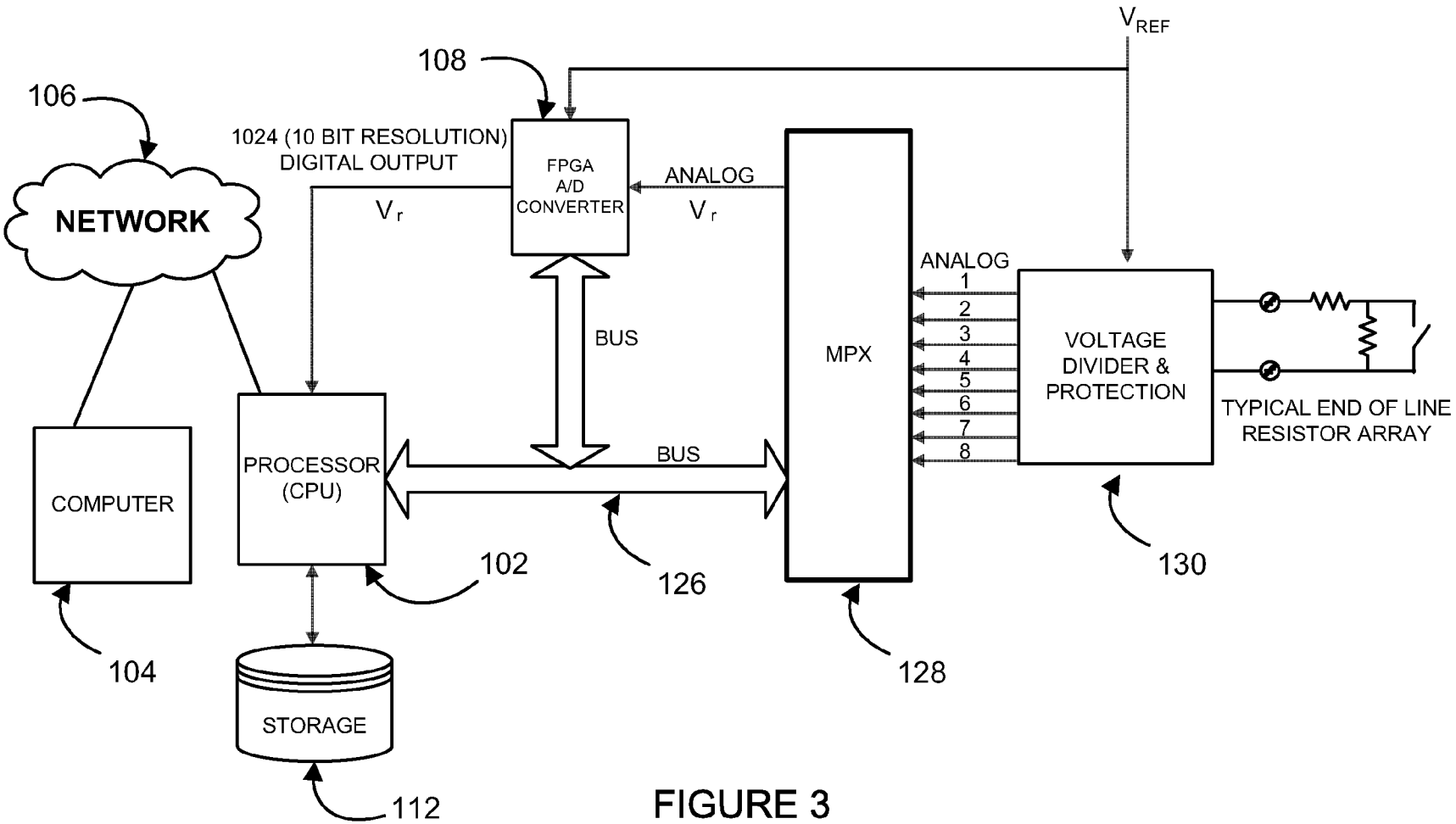
FIG. 3 is a block diagram of the advantageous embodiment according to FIG. 1.

Referring now to FIG. 3, $V_r$ is fed to a 10 bit Analog to Digital Converter (ADC) 108 that produces a digital value of $V_r$ with a granularity of up to, in one embodiment, 1024 segments. The digital value is then fed to a processor 102. The user may then set an acceptable "window" for the Normal (secure) and Alarm conditions. Having such a window allows the user to set "sensitivity" to the Normal and Alarm conditions.

In this manner, the system can then "learn" what "Normal (secure)" is, or "Alarm" condition, by simply prompting the user to set the sensor into the "Normal" or "Alarm" mode. That is, regardless of the value of the field installed EOL resistor, the system can teach itself of such state, and use it as a reference for future device state detection. For example, when an existing EOL resistor(s) monitoring whether a door is open or closed is coupled to the intelligent security system, the user will indicate to the system that, for example, the door is closed. The system will then "learn" the value of the door closed state and will store this information. The user will then open the door and will indicate this to the system, which will then "learn" the value of the door open state and will also store this information. In this manner, the system will automatically calibrate itself to the attached resistor(s) without the user having to replace or even enter the value into the system.

As can further be seen from FIG. 3, processor 102 is coupled to ADC 108 and multiplexer 128 via bus 126. Further, multiplexer 128 is coupled to voltage divider and protection 130 via lines (1-8).

Figure 4:
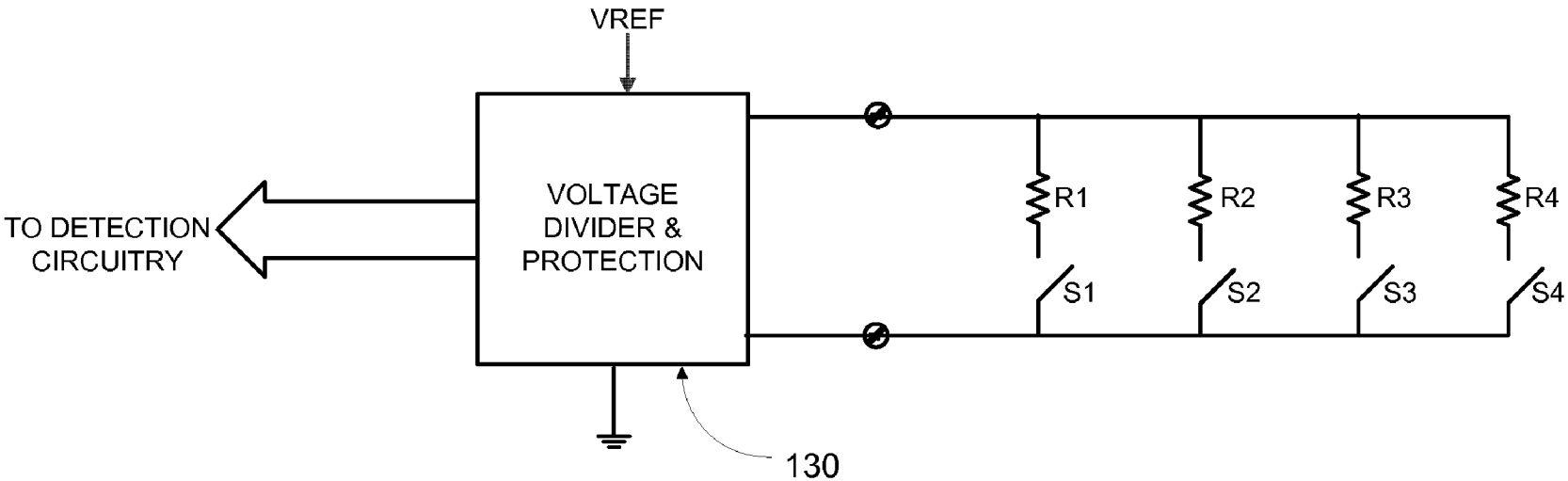
FIG. 4 is a block diagram of the advantageous embodiment according to FIG. 2.

Referring now to FIG. 4, it is noted that by the use of just a pair of wires and different values for the EOL resistor, the system can monitor multiple devices without the need for a remotely installed digital multiplexer. For example, assuming an emergency generator that is installed in a remote location that requires monitoring, by the use of this technology, the intelligent security system can monitor several alarm sensors via the use of the same single pair of wires.

Output Supervision. Electronic access control is a segment of the overall security system, in which, a Card Reader is installed by an area entry door to control access to the area. Electronic Card Access readers take a variety of forms, from magnetic swipe, to electronic proximity, Smart Cards, to Biometric Readers. Users typically are provided with an electronic credential card, or tag, in which a unique identifying strip or chip is embedded. Upon presentation of the credential card to the reader, a series of identifying bits is extracted from the card, and then routed to an access control processor, which verifies the validity of the card, and if access is to be granted, a relay is triggered to unlock the electrified lock controlling the door and therefore granting access to the authorized user.

For a typical access controlled door to function correctly, in addition to the electronic card reader and the electrified lock, other electrified devices, such as Request to Exit (REX) sensor, as well as Door Status Monitor (DSM) switch, are needed. Some high security doors require additional components, such as local strobes, sirens and others, all, typically requiring electrical power to function.

Electrified locks, for example, are available in several varieties, from a jamb mounted electrified strike, to door mounted electrified mortise lock, and electrified panic hardware to magnetic door holders and others. Depending on type and configuration, low voltage electrified locks typically require from 12 Volts to 24 Volts, both in AC and DC forms. Standard Wiegand card readers require between 5VDC to 24VDC. Depending on the type, a typical Request to Exit (REX) motion sensor requires from 12V to 24V, AC or DC.

Unlike a Door Status Monitor (DSM) switch, which utilizes End Of Line (EOL) supervision resistors for device and cable status monitoring, devices such as Wiegand card readers, electrified locks, REX motion sensors, sirens, strobes and countless others are considered to be "non-supervised". That means that neither the access controller nor the installer/manager can determine either the correct presence of such non-supervised devices, nor can they determine the type or condition of the non-supervised device.

Historically the inability to identify or verify the state of non-supervised devices has been a source of costly and time consuming repairs. When trouble is reported for the non-supervised device, the service center must dispatch a technician to the site who has to engage in a series of trouble-shooting measures in order to identify the source of the failure. Failures can range from cut or shorted wires to the device, to loose connections, faulty devices, etc.

Via the use of the standard remote management/configuration computer, sometimes miles or cities away, the present invention provides for a mechanism by which the manager of the security system can remotely interrogate, diagnose and verify the status of these historically "non-supervised" devices without the need to be on site. Further, in the case of an unexpected shorted wire, shorted device or current overdraw scenarios, the system automatically notifies the administrator/manager of the problem in advance of receiving a customer complaint. The ability to interrogate these non-supervised sensors and receive automatic alarm conditions from them remotely via the use of the same management/configuration computer and software provides a major time and cost savings for system managers and for customer end users, as it eliminates the need for a site travel and visit.

Figure 5:
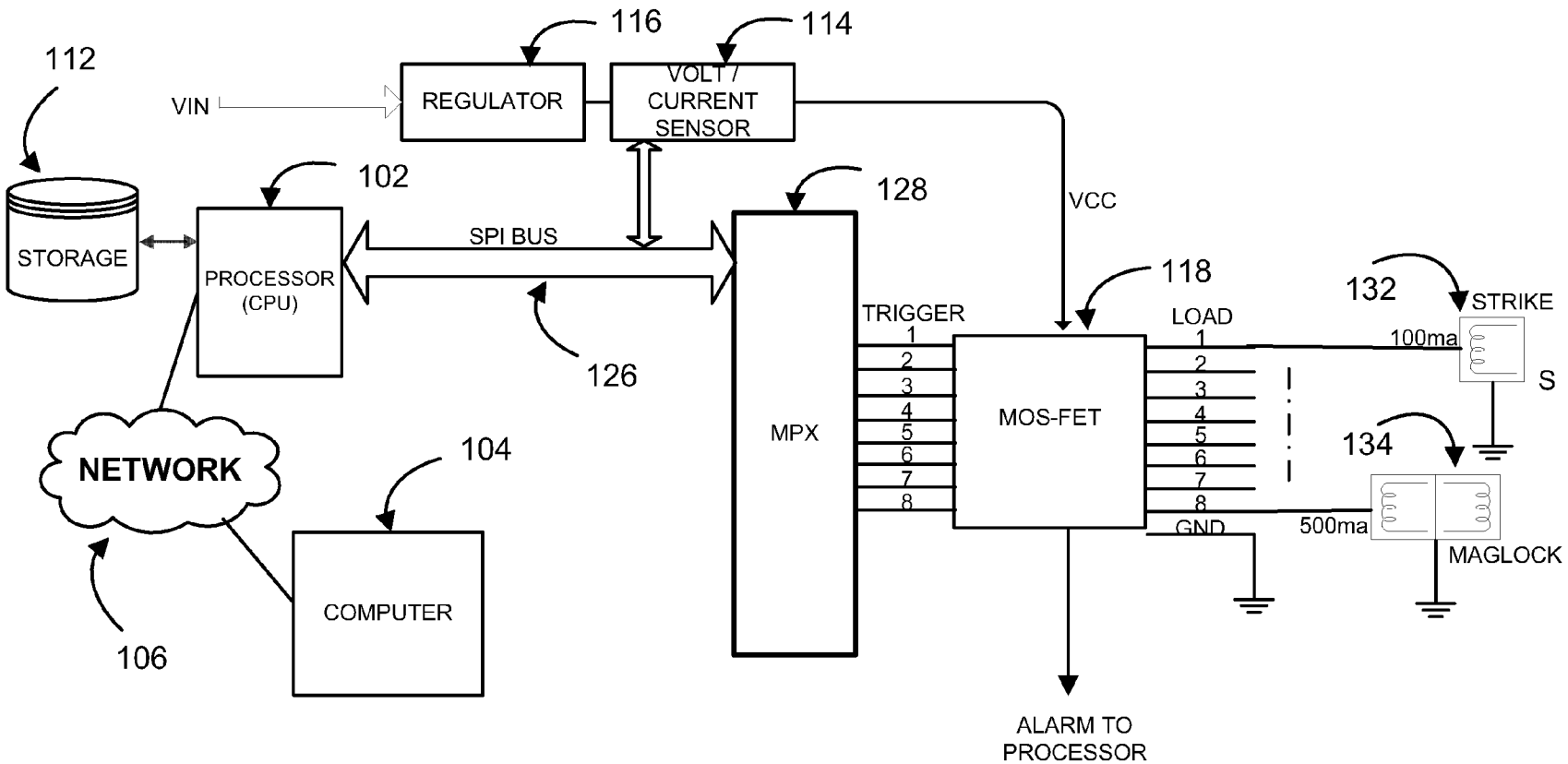
FIG. 5 is a block diagram of the advantageous embodiment according to FIG. 1.

FIG. 5 details the various modules used in one advantageous embodiment to achieve supervision and status monitoring of non-supervised devices. For the purpose of this illustration, an electrical door strike 132 and an electrified magnetic door holder 134 are connected to a commercially available MOS FET device 118 (as previously described in connection with FIG. 1). MOS FET 118 is utilized since it natively provides for power distribution, current limiting and over current notification. FIG. 5 illustrates, for example, an eight port MOS FET device with an individual input trigger control per output. In this configuration, input #1 controls output #1 of the MOS FET. This provides for the ability to turn on or off the output powering the electrified strike 132. The inputs of the MOS FET 118 are connected to an eight port multiplexer 128. The multiplexer 128 is controlled by the processor 102, which is coupled to a storage 112. Since the microprocessor is controlled by the remote computer 104, the manager, via the use of the remote computer 104, can control the processor 102, which in turn controls the multiplexer 128, which controls MOS FET 118. MOS FET 118 is powered by a regulated and monitored power supply 116 and voltage/current sensor 114. Voltage/current sensor 114 has built-in several voltage and current sensing circuitry which report to the processor 102.

The following is an example of a sequence of operation of the embodiment illustrated in FIG. 5. It should be noted that, while various functions and methods will be described and presented in a sequence of steps, the sequence is provided merely as an illustration of one advantageous embodiment, and that it is not necessary to perform these functions in the specific order illustrated. It is further contemplated that any of these steps may be moved and/or combined relative to any of the other steps. In addition, it is still further contemplated that it may be advantageous, depending upon the application, to utilize all or any portion of the functions described herein.

A typical electrified strike 132 is known to draw approximately 100 milliamps. A typical electrified magnetic door holder 134 is known to draw approximately 500 milliamps. Under normal operation, power ($V_{IN}$) is applied to the voltage regulator 116. This regulator feeds the MOS FET 118 thru voltage/current sensor 114. MOS FET 118 provides power to the various auxiliary remote devices such as: electrified locks, electronic card readers, electronic motion sensors, sirens, strobes, etc. In the "normal" state, the sum of current drawn by all remote devices is monitored and reported by voltage/current sensor 114. For example, the total current drawn and sensed by the voltage/current sensor 114 in this example is 900 milliamps. In the diagnostic/interrogation software mode, a command is sent by the operator via the remote computer 104 to turn off input #1 of MOS FET 118 for a short period of time for example 10 milliseconds. During this "off" time period, a second current measurement is taken and noted by volt/current sensor 114. If for example, the overall current sensed and drawn drops from 900 milliamps to 800 milliamps, then it is reasonable to assume that a) a load is present on output #1 (in this case an electrified strike 132) and b) by the amount of current drop (i.e. 100 milliamps) it is reasonable to assume that the load is an electrified strike and not a magnetic door holder which draws 500 milliamps and would have shown a more significant drop current drop to a total of 400 milliamps.

As described, the manager, using the remote computer 104 can command, monitor and analyze these current draw differentials and determine the presence and type of the remote powered device. The manager is now provided with an important tool with the capability to remotely diagnose and identify whether these "non-supervised" devices are wired and present, if wired properly, and the device's estimated model type. There is no need then to dispatch a technician to the site, resulting in significant time and cost savings.

Another advantage provided by the ability of cycling on/off all the input to the MOS FET 118 is the ability to remotely clear alarms. For example, in the event an alarm is generated by a RMD, the alarm is received at computer 104 via network connection 106. An individual monitoring the alarm can then cycle through the various inputs to MOS FET 118 sequentially to see which input will cause the alarm to cease. Often, the cycling of the input on/off will clear the alarm condition negating the necessity of sending a technician to the site. If, however, the alarm is not clear, the technician is given specific information as to what device is in alarm so that the technician can go straight to the problem and location with little or no need to trouble-shoot at the controller location.

Further, according to another embodiment, an automatic routine is established in which at a predetermined time interval, the microprocessor momentarily turns off in a sequential order all inputs to the MOS FET 118 and then performs an automatic and routine analysis of the current measurements and reports any unexpected abnormalities as trouble.

In summary, the intelligent security system makes use of a small, modular, rack mountable controller that fit easily within standard 19" data style racks. This approach makes security equipment "Data Center compliant" with its many benefits. Additionally, security controllers can now be easy to install, terminate, program, maintain and remotely monitor.

These controllers provide ample status indicators, diagnostics, and remote diagnostics for system commissioning and ongoing maintenance.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An intelligent security system comprising:

an integrated circuit having a first and a second input and a first and a second output corresponding to the first and second inputs, said integrated circuit also having an alarm output;

a processor coupled to the at least two inputs and to the alarm output and coupled to a storage;

a computer coupled to said processor via a network connection;

said first output coupled to a first remotely monitored device and said second output coupled to a second remotely monitored device;

a threshold value stored in said storage and a first measured value for said first remotely monitored device and a second measured value for said second remotely monitored device, wherein if either the first or second measured values exceed the threshold value, a alarm signal is send via the alarm output;

said computer transmitting a command signal to said processor to turn one of the first or second inputs off;

wherein the remotely monitored device that is in causing the alarm is identified by the cycling on and off of the first and second inputs;

at least one end-of-line resistor located in the vicinity of said first remotely monitored device, said at least one end-of-line resistor comprising a circuit coupled to said integrated circuit;

said processor applying a current across the circuit;

said processor measuring a voltage that develops across the circuit and determining a resistance thereof;

said processor storing the circuit resistance in said storage;

said processor automatically setting its operational settings in accordance with the circuit resistance such that when said processor reads the circuit resistance the system registers normal operation;

wherein when said processor reads a resistance that exceeds a threshold deviation from the circuit resistance, the system registers an alarm.

2. The intelligent security system according to claim 1 wherein said first and second remotely monitored devices comprise an electrified lock, an access card reader, a door status monitor and/or a request to exit device.

3. The intelligent security system according to claim 1 further comprising an analog-to-digital converter, wherein said analog-to-digital converter is coupled to said at least one end-of-line resistor.

4. The intelligent security system according to claim 3 further comprising a multiplexer coupled between said first and second remotely monitored devices and said processor.

5. The intelligent security system according to claim 1 further comprising a voltage regulator coupled to said processor.

6. The intelligent security system according to claim 5 further comprising a voltage and current sensor coupled to said regulator.

7. The intelligent security system according to claim 1 wherein said integrated circuit comprises a MOS FET.

8. The intelligent security system according to claim 1 wherein the first remotely monitored device has at least two conditions and the circuit reads different resistance readings for the two different conditions, said processor storing the circuit resistance for the two different conditions.

* * * * *